US007216501B2

(12) United States Patent
Terada

(10) Patent No.: US 7,216,501 B2
(45) Date of Patent: May 15, 2007

(54) INDOOR UNIT FOR AIR CONDITIONER

(75) Inventor: Yuichi Terada, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 202 days.

(21) Appl. No.: 10/534,048

(22) PCT Filed: Nov. 20, 2003

(86) PCT No.: PCT/JP03/14861

§ 371 (c)(1),
(2), (4) Date: May 6, 2005

(87) PCT Pub. No.: WO2004/057242

PCT Pub. Date: Jul. 8, 2004

(65) Prior Publication Data

US 2006/0112710 A1 Jun. 1, 2006

(30) Foreign Application Priority Data

Dec. 2, 2002 (JP) ..... 2002-350028
Dec. 2, 2002 (JP) ..... 2002-350029

(51) Int. Cl.
*F25D 21/14* (2006.01)

(52) U.S. Cl. ..... 62/285

(58) Field of Classification Search ..... 62/186, 62/263, 280, 285, 288, 291, 298, 426; 165/122
See application file for complete search history.

(56) References Cited

U.S. PATENT DOCUMENTS 3,741,290 A * 6/1973 Nenadal ..... 165/48.1
4,541,847 A * 9/1985 Oie et al. ..... 96/58
5,055,115 A * 10/1991 Yikai et al. ..... 96/59
5,332,425 A * 7/1994 Huang ..... 96/26
5,341,650 A * 8/1994 Nagasawa et al. ..... 62/180
5,445,214 A * 8/1995 Han ..... 165/11.1
5,678,417 A * 10/1997 Nigo et al. ..... 62/186
6,477,854 B2 * 11/2002 Chung et al. ..... 62/280
6,557,364 B2 * 5/2003 Gunji et al. ..... 62/263
2002/0029583 A1 * 3/2002 Chung et al. ..... 62/428
2002/0144513 A1 * 10/2002 Gunji et al. ..... 62/263

FOREIGN PATENT DOCUMENTS

JP 09-21544 A 1/1997
JP 09-96423 A 4/1997
JP 200-28156 A * 1/2000
JP 2001-221497 A 8/2001
JP 2002-106953 A 4/2002
JP 2002-213766 A 7/2002
JP 2002-276991 A 9/2002
KR B-10-0196118 2/1997

* cited by examiner

*Primary Examiner*—Mohammad M. Ali
(74) *Attorney, Agent, or Firm*—Global IP Counselors, LLP

(57) ABSTRACT

The indoor unit for an air conditioner comprises a cross flow fan, an indoor heat exchanger, an auxiliary pipe, an indoor fan motor, a motor cover section, a front drain pan, a rear drain pan, and a communication passage. The communication passage is arranged adjacent to the motor cover section along the rotational axis in a top plan view and serves to link the front drain pan and the rear drain pan together. The cross flow fan, the indoor fan motor and the communication passage are arranged such that in a top plan view they are positioned along the rotational axis in the following order: the cross flow fan, the indoor fan motor, and the communication passage.

24 Claims, 10 Drawing Sheets

INDOOR UNIT FOR AIR CONDITIONER

CROSS-REFERENCE TO RELATED APPLICATIONS

This nonprovisional application claims priority under 35 U.S.C. §119(a) to Japanese Patent Application Nos. 2002-350028, filed in Japan on Dec. 2, 2002, and 2002-350029, filed in Japan on Dec. 2, 2002, the entire contents of which are hereby incorporated by reference.

TECHNICAL FIELD

The present invention relates to an indoor unit for an air conditioner.

BACKGROUND ART

An indoor unit of an air conditioner is equipped with a blower fan, a motor, and a heat exchanger and serves to deliver air that has passed through the heat exchanger into a room. The motor serves to rotationally drive the blower fan, and the blower fan and motor are arranged adjacent to each other along the rotational axis of the blower fan.

The indoor unit of the air conditioner is further equipped with a first drain pan and a second drain pan to catch drain water that drips from the forward end and rearward end of the heat exchanger and a communication passage to link the first and second drain pans together. By providing a communication passage, the water caught by the first drain pan and the second drain pan can be collected in either one of the drain pans or in the communication passage and discharged to the outside of the indoor unit. In conventional indoor units, the communication passage is often arranged between the blower fan and the motor in a top plan view. More specifically, the blower fan, the communication passage, and the motor are often arranged such that in a top plan view they are positioned along the rotational axis of the blower fan in the following order: blower fan, communication passage, motor (see Japanese Laid-Open Patent Publication No. 2001-221497).

However, in an indoor unit of an air conditioner, water drips not only from the heat exchanger but also from the auxiliary pipe that extends outward from the side face of the heat exchanger. Consequently, a motor cover that covers the motor is arranged below the auxiliary pipe to protect the motor from the drain water. In some cases, the disposal of the drain water that drips onto the motor cover is problematic. When the communication passage is arranged between the blower fan and the motor along the rotational axis of the blower fan in a top plan view, it is necessary to prevent the drain water caught by the motor cover from flowing toward the outside, i.e., toward the opposite side as the side where the blower fan is located. The idea of as providing ribs on the motor cover to guide the drain water away from the outside have been tried as a means of preventing the drain water from flowing to the outside, but such designs cause the shape of the motor cover to become complex and the manufacturing cost to increase.

SUMMARY OF THE INVENTION

The object of the present invention is to provide an indoor unit for an air conditioner that can dispose of drain water using a simple configuration.

According to a first aspect of the present invention, an indoor unit for an air conditioner is provided with a blower fan, a heat exchanger, an auxiliary pipe, a motor, a motor cover, a first drain pan, a second drain pan, and a communication passage. The blower fan has a cylindrical shape and is arranged such that its rotational axis is substantially horizontal. The heat exchanger is arranged so as to cover the blower fan from above and face the outer circumference of the blower fan. The auxiliary pipe extends outward from an side face of the heat exchanger. The motor is arranged adjacent to the blower fan along the rotational axis and serves to rotationally drive the blower fan. The motor cover is arranged below the auxiliary pipe and covers the motor. The first drain pan and second drain pan are arranged in such a manner as to sandwich the blower fan from the front and rear and serve to catch drain water that drips from the heat exchanger. The communication passage is arranged adjacent to the motor cover along the rotational axis in a top plan view and serves to link the first drain pan and the second drain pan together. The blower fan, the motor, and the communication passage are arranged such that in a top plan view they are positioned along the rotational axis in the following order: blower fan, motor, communication passage.

With this air conditioner indoor unit, the communication passage can catch any drain water that flows outward after dripping onto the motor cover that covers the motor because the blower fan, the motor, and the communication passage are arranged in said order along the rotational axis of the blower fan in a top plan view. As a result, this air conditioner indoor unit enables the drain water to be disposed of using a simple configuration.

According to a second aspect of the present invention, the air conditioner indoor unit of the first aspect of the present invention is further provided with an electrical component box for housing electrical components. The blower fan, the motor, the communication passage, and the electrical component box are arranged such that in a top plan view they are positioned along the rotational axis in the following order: blower fan, motor, communication passage, electrical component box.

In this air conditioner indoor unit, the communication passage is arranged between the electrical component box and the motor. Consequently, drain water that drips onto the motor cover can be caught by the communication passage and prevented from flowing toward the electrical component box. As a result, this air conditioner indoor unit enables the drain water to be prevented from flowing toward the electrical component box using a simple configuration.

According to a third aspect of the present invention, the air conditioner indoor unit of the first or second aspect of the present invention further provided with a water guiding passage configured to guide drain water that has dripped onto the motor cover toward the communication passage.

With this air conditioner indoor unit, drain water that drips onto the motor cover is guided toward the communication passage by the guide passage. As a result, this air conditioner indoor unit can dispose of the drain water more efficiently.

According to a fourth aspect of the present invention, the air conditioner indoor unit of anyone of the first to third aspects of the present invention is provided such that the auxiliary pipe extends to the space above the communication passage.

In this air conditioner indoor unit, the auxiliary pipe extends to the space above the communication passage. That is, the auxiliary pipe is positioned not only above the motor cover but extends beyond the motor cover to the space above the communication passage. As a result, with this air conditioner indoor unit, the installation space of the auxiliary pipe is enlarged such that the degree of freedom with respect to the installation of the auxiliary pipe is increased.

According to a fifth aspect of the present invention, the air conditioner indoor unit of anyone of the first to fourth aspects of the present invention is provided such that the communication passage is positioned at or below the height of the rotational axis of the blower fan.

With this air conditioner indoor unit, the communication passage is positioned at or below the height of the rotational axis of the blower fan, which is a comparatively low position within the air conditioner indoor unit. Thus, the positions of the first drain pan and the second drain pan can also be lowered, as can the position of the heat exchanger. As a result, the height dimension of the air conditioner indoor unit can be decreased.

According to a sixth aspect of the present invention, the air conditioner indoor unit of anyone of the first to fifth aspects of the present invention is provided such that the first drain pan, the communication passage, and the second drain pan are formed as a single integral unit.

In this air conditioner indoor unit, the first drain pan, the communication passage, and the second drain pan are formed as a single integral unit. If these items are formed as separate units and joined together, there will be the possibility that drain water will leak from the joint portions. With this air conditioner indoor unit, the risk of water leakage occurring can be reduced because said items are formed as a single integral unit.

According to a seventh aspect of the present invention, the air conditioner indoor unit of the sixth aspect of the present invention is further provided with a water draining section. The water draining section is provided with a water draining hole configured to discharge drain water from the first drain pan, the communication passage, and the second drain pan to the outside of the indoor unit. The first drain pan, the communication passage, the second drain pan, and the water draining section are formed as a single integral unit.

Drain water flows not only to the first drain pan, the communication passage, and the second drain pan but also from these items to the water draining section to be discharged to the outside of the indoor unit. Thus, there is the possibility that drain water will leak from the joint section if the water draining section is formed as a separate unit and joined to the communication passage, etc.

In this air conditioning indoor unit, however, the first drain pan, the communication passage, the second drain pan, and the water draining section are formed as a single integral unit. As a result, the risk of water leakage occurring can be reduced even further.

According to an eighth aspect of the present invention, the air conditioner indoor unit of the first aspect of the present invention is provided such that the auxiliary pipe extends to a position beyond the motor in a direction parallel to the rotational axis.

Generally speaking, an air conditioner indoor unit has a cylindrical blower fan, a heat exchanger arranged facing the outer circumference of the blower fan, and a motor that is arranged adjacent to the blower fan along the rotational axis and configured to rotationally drive the blower fan. An auxiliary pipe through which a refrigerant flows is connected to the heat exchanger. The auxiliary pipe often extends outward from the side face of the heat exchanger and routed through the space adjacent to the side face of the heat exchanger in order to be connected to the refrigerant piping located outside the indoor unit. (See Japanese Laid-Open Patent Publication No. 11-173591.)

Meanwhile, a plurality of component parts are densely arranged inside the air conditioner indoor unit in order to make the indoor unit more compact. For example, the motor is often arranged in the space adjacent to the side face of the heat exchanger and thus occupies a portion of the space adjacent to the side face of the heat exchanger. Consequently, the space that can be used for installing the auxiliary pipe that extends outward from the side face of the heat exchanger is limited and the degree of freedom with which the auxiliary pipe can be routed is limited. From the standpoint of design ease, it is preferable for the degree of freedom with respect to routing the auxiliary pipe to be high.

In this air conditioner outdoor unit, the auxiliary pipe that extends from the side face of the heat exchanger extends to a position beyond the motor. If the auxiliary pipe is not extended to a position beyond the motor and the motor is positioned below the auxiliary pipe, at least a portion of the space below the auxiliary pipe will be occupied by the motor and the ability to extend the auxiliary pipe downward will be restricted. Conversely, with this air conditioner indoor unit, there is little chance of the motor limiting the ability to extend the auxiliary pipe downward because the auxiliary pipe extends to a position beyond the motor. As a result, with this air conditioner indoor unit, the degree of freedom with which the auxiliary pipe can be routed is higher than when the auxiliary pipe does not extend to a position beyond the motor. In short, with this air conditioner indoor unit, the degree of freedom with respect to routing the auxiliary pipe can be increased.

According to a ninth aspect of the present invention, the air conditioner indoor unit of the eighth aspect of the present invention is provided such that the auxiliary pipe extends to a position beyond the motor cover in a direction parallel to the rotational axis.

With this air conditioner indoor unit, there is little chance of the routing of the auxiliary pipe being limited by the motor cover because the auxiliary pipe extends to a position beyond the motor cover in a direction parallel to the rotational axis. As a result, with this air conditioner indoor unit, the degree of freedom with respect to routing the auxiliary pipe can be increased.

According to a tenth aspect of the present invention, the air conditioner indoor unit of the ninth aspect of the present invention is provided such that the communication passage is arranged in a position beyond the motor cover in a direction parallel to the rotational axis.

In this air conditioner indoor unit, the communication passage is arranged in a position beyond the motor cover. As a result, the communication passage can catch drain water that drips from an auxiliary pipe extending to a position beyond the motor cover. Thus, with this air conditioner indoor unit, even if the auxiliary pipe extends to a position beyond the motor cover, the drain water that drips from the auxiliary pipe can be disposed of appropriately.

BRIEF DESCRIPTIONS OF THE DRAWINGS

FIG. 3(*b*) is a right side view of the indoor unit.

DETAILED DESCRIPTION OF THE PREFERRED EMBODIMENTS

<Overall Configuration of the Air Conditioner>

Figure 1:
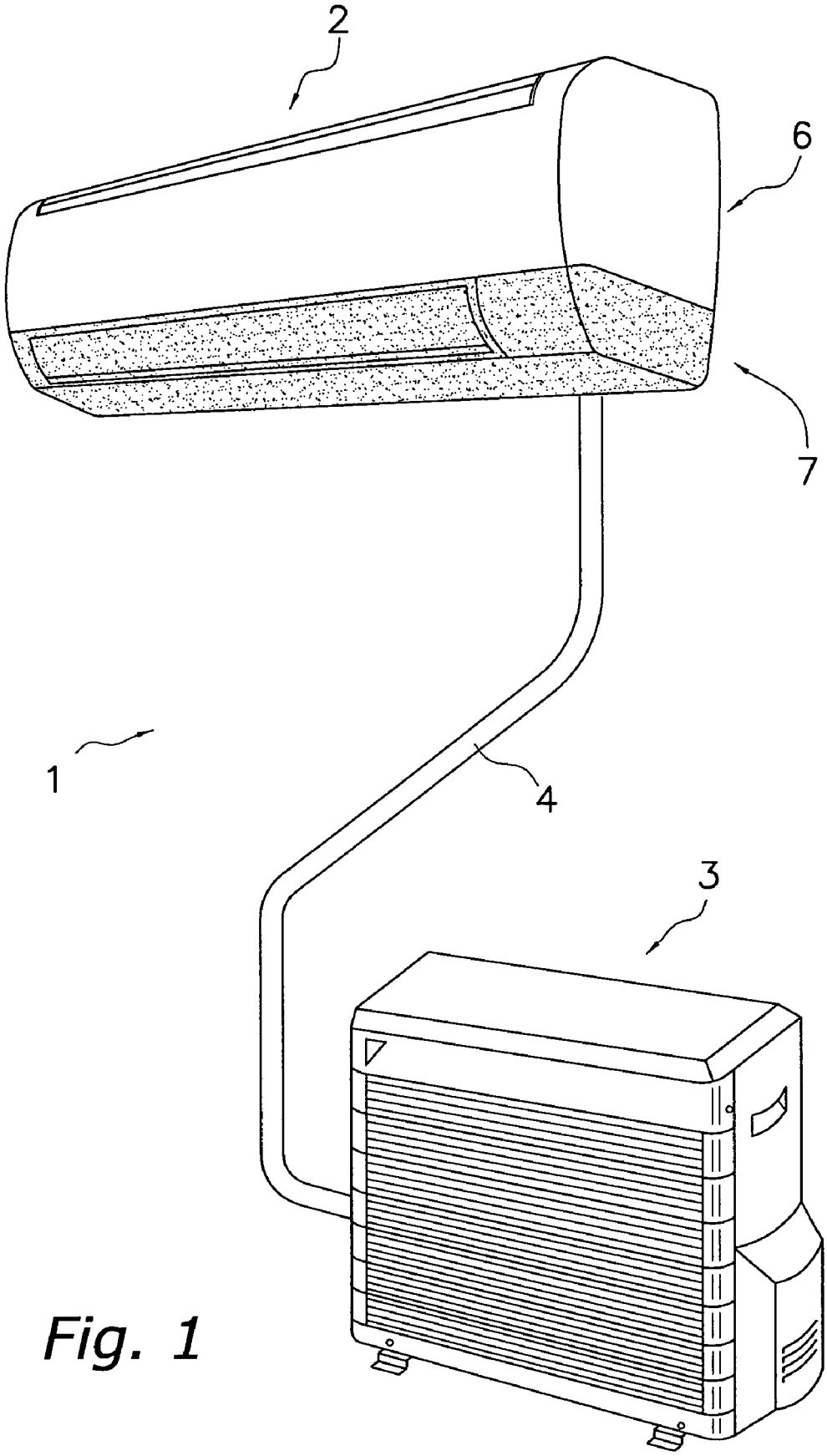
FIG. 1 shows the external appearance of an air conditioner.

FIG. 1 shows the external appearance of an air conditioner 1 that employs an embodiment of the present invention.

The air conditioner 1 comprises an indoor unit 2 configured to be mounted to an indoor wall and an outdoor unit 3 configured to be installed outdoors.

An indoor heat exchanger 50 (heat exchanger) is housed inside the indoor unit 2 and an outdoor heat exchanger 30 is housed inside the outdoor unit 3. The heat exchangers 30, 50 are connected by a refrigerant pipe 4, thereby forming a refrigerant circuit.

<Overview of the Refrigerant Circuit of the Air Conditioner>

Figure 2:
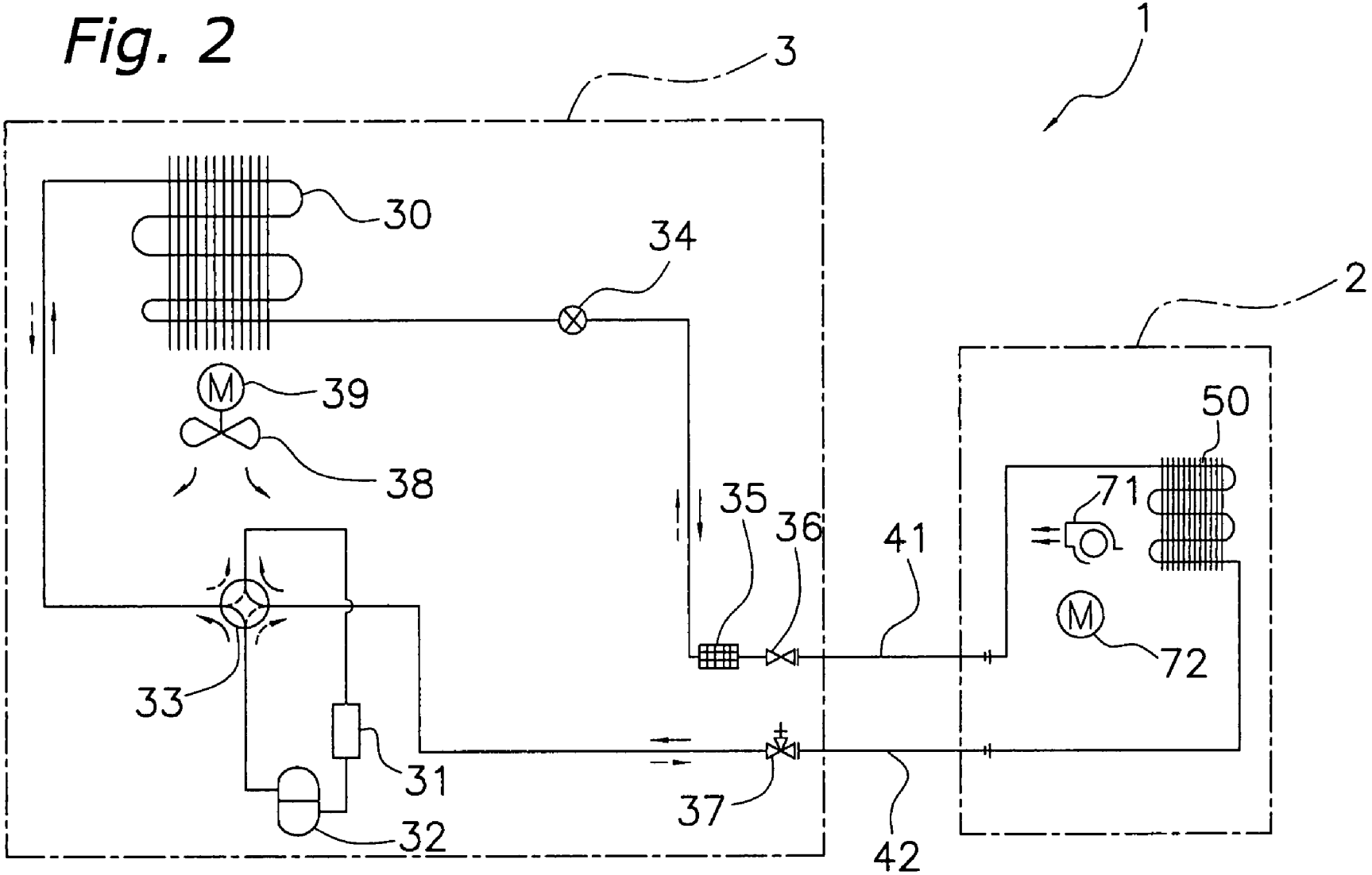
FIG. 2 is a schematic view of the refrigerant circuit.

The constituent features of the refrigerant circuit of the air conditioner 1 are shown in FIG. 2. This refrigerant circuit comprises chiefly the indoor heat exchanger 50, an accumulator 31, a compressor 32, a four-way selector valve 33, the outdoor heat exchanger 30, and an electric powered expansion valve 34.

The indoor heat exchanger 50 provided in the indoor unit 2 serves to exchange heat between the refrigerant and the air that contacts the indoor heat exchanger 50. The indoor unit 2 is also provided with a cross flow fan 71 (blower fan) for drawing air from the room (indoor space) into the indoor unit 2 and discharging the air to the room after the air has exchanged heat with the heat exchanger 50. The cross flow fan 71 has an elongated cylindrical shape and is arranged such that its center axis is oriented in a horizontal direction. The cross flow fan 71 is driven by an indoor fan motor 72 (motor) provided inside the indoor unit 2 so as to rotate about its center axis. The constituent features of the indoor unit 2 will be discussed in more detail later.

The outdoor unit 3 includes the following components: the compressor 32; the four-way selector valve 33, which is connected to the discharge side of the compressor 32; the accumulator 31, which is connected to the intake side of the compressor 32; the outdoor heat exchanger 30, which is connected to the four-way selector valve 33; and the electric powered expansion valve 34, which is connected to the outdoor heat exchanger 30. The electric powered expansion valve 34 is connected to a pipe 41 through a filter 35 and a liquid shut-off valve 36 and, furthermore, is connected to one end of the indoor heat exchanger 50 through the pipe 41. The four-way selector valve 33 is connected to a pipe 42 through a gas shut-off valve 37 and, furthermore, is connected to the other end of the indoor heat exchanger 50 through the pipe 42. These pipes 41, 42 are equivalent to the refrigerant pipe 4 shown in FIG. 1. The outdoor unit 3 is further provided with a propeller fan 38 for discharging air to the outside after the air has exchanged heat with the outdoor heat exchanger 30. The propeller fan 38 is rotationally driven by an outdoor fan motor 39.

<Constituent Features of the Indoor Unit>

Figure 3B:
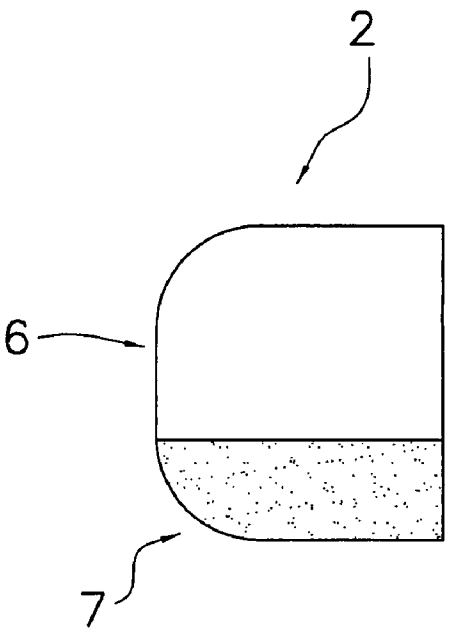
FIG. 3(*a*) is a frontal view of an indoor unit.
Figure 3A:
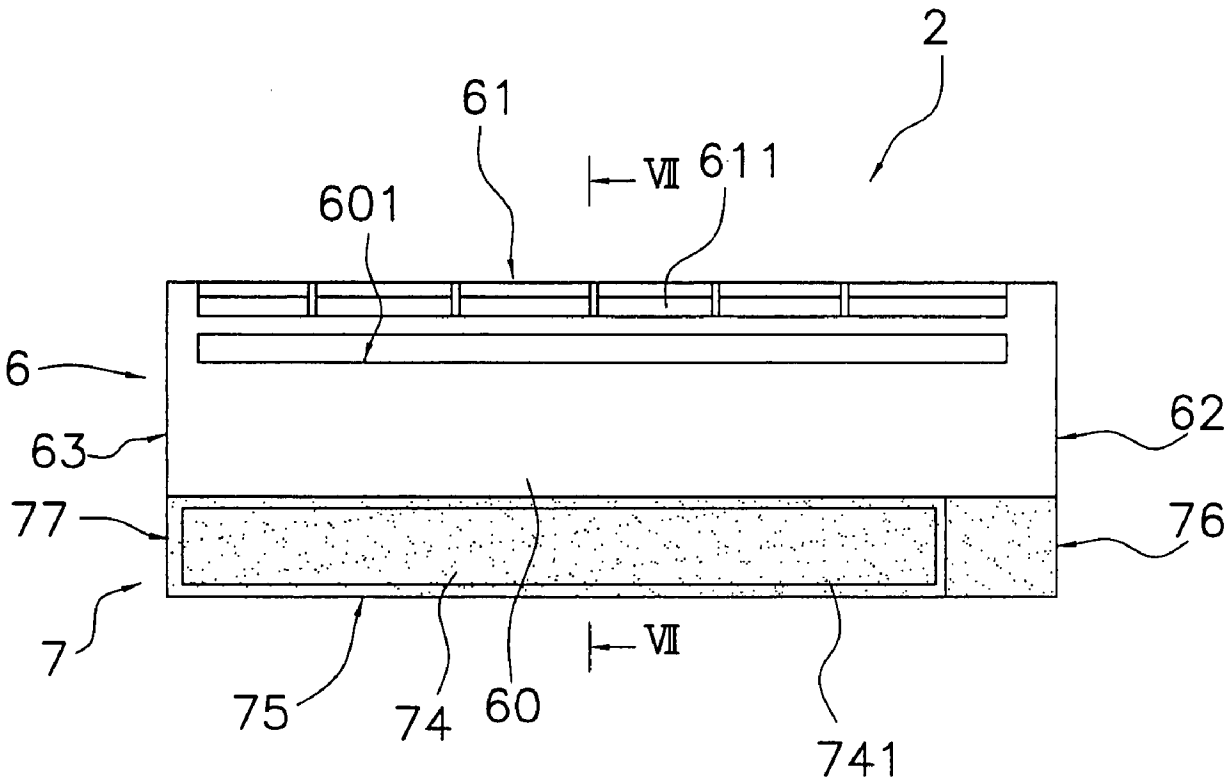

FIG. 3(*a*) shows a frontal view of the indoor unit 2 and FIG. 3(*b*) shows a side view of the indoor unit 2. The indoor unit 2 has a horizontally long form in a frontal view and has a two-tone color scheme whereby the color is divided between an upper portion and a lower portion in both a frontal view and a side view.

The indoor unit 2 comprises chiefly an upper casing 6, a lower unit 7, and an indoor heat exchanger unit 5 housed inside the indoor unit 2. The upper casing 6 covers the upper part of the indoor unit 2. The lower unit 7 constitutes the lower part of the indoor unit 2. The upper casing 6 and the lower unit 7 are formed as separate entities, and the boundary between the upper casing 6 and a portion of the lower unit 7 appears as a horizontal line in an external view of the indoor unit 2. The color of the upper casing 6 is different from the color of the portion of the lower unit 7 such that a two-tone color scheme is achieved in which the color differs above and below the aforementioned horizontal line forming the boundary between the upper casing 6 and the lower unit 7.

The constituent components of the indoor unit 2 will now be described individually.

<Indoor Heat Exchanger Unit>

Figure 4:
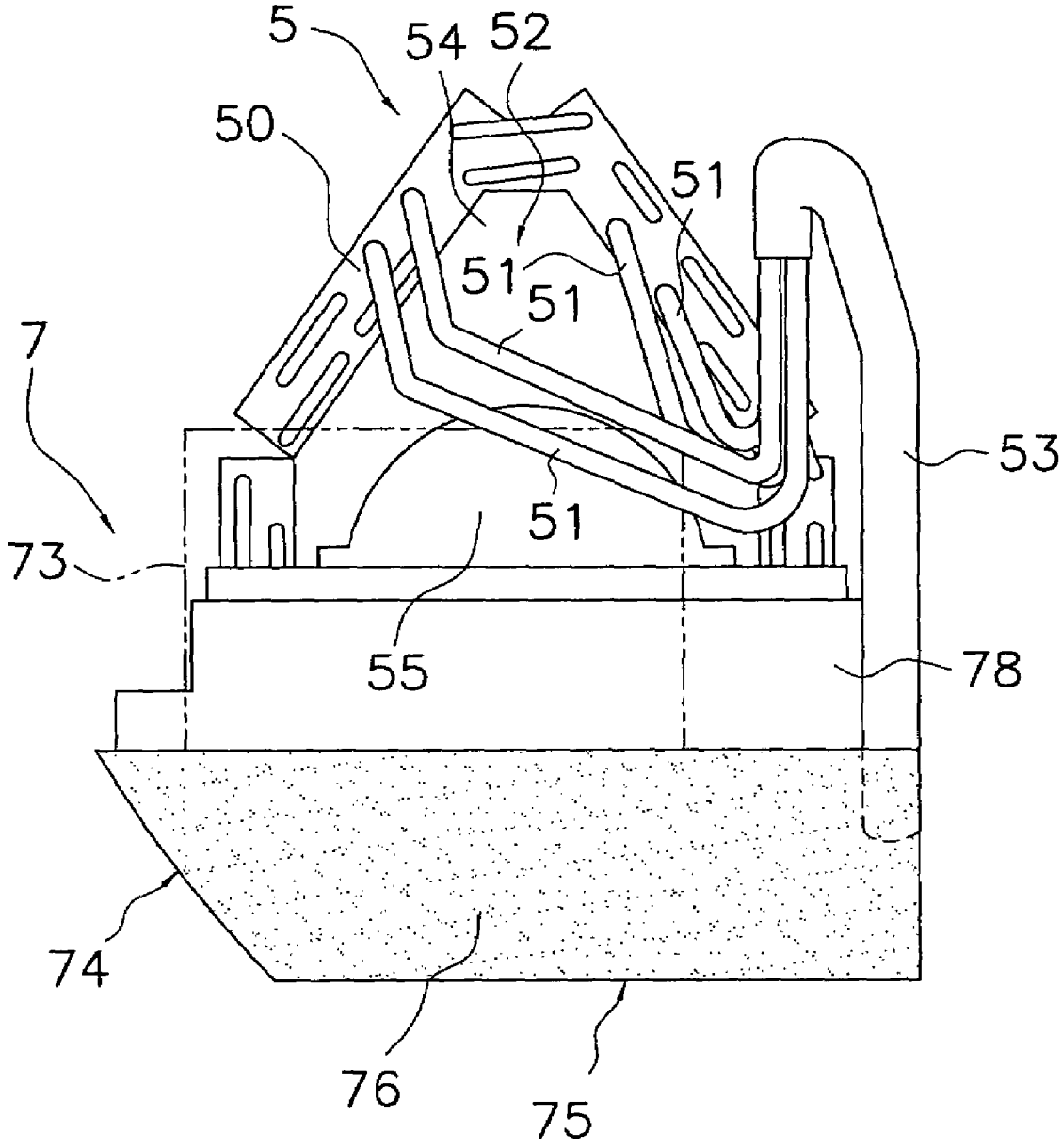
FIG. 4 is a right side view of the indoor unit with an upper casing removed.
Figure 5:
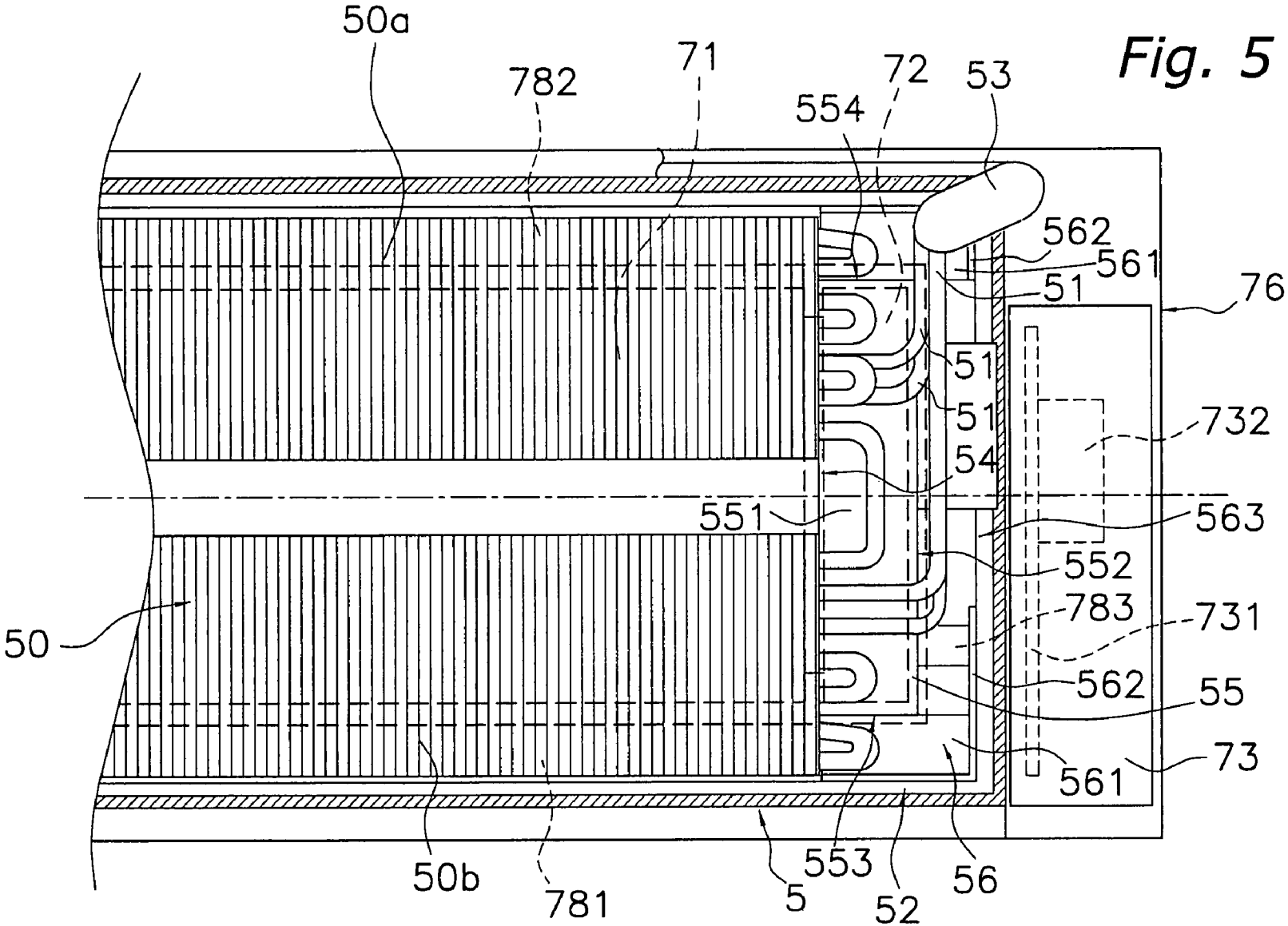
FIG. 5 is a top view of the right-hand portion the indoor unit with the upper casing removed.
Figure 6:
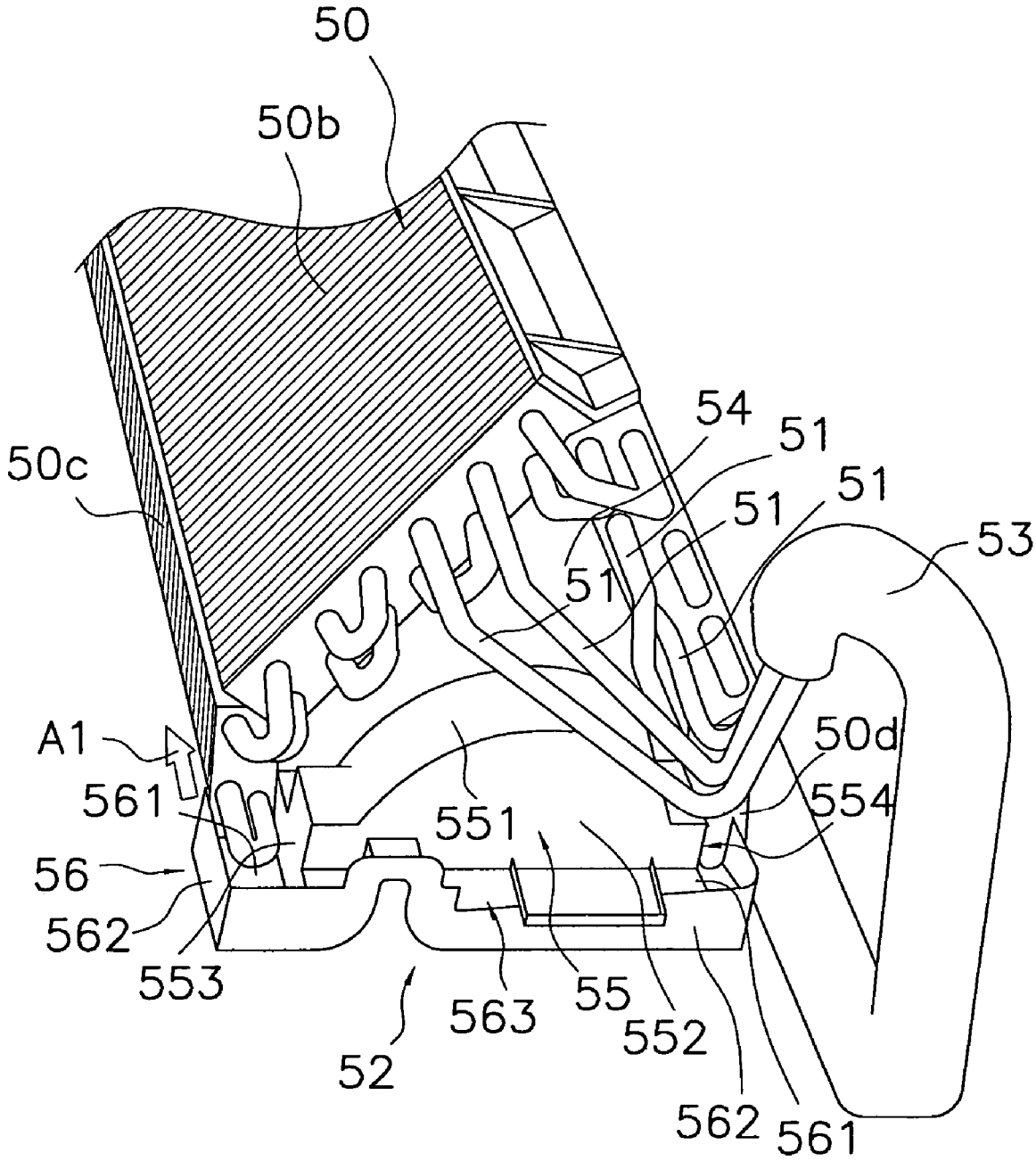
FIG. 6 is a perspective view of the right-hand portion of an indoor heat exchanger unit.

As shown in FIGS. 4 to 6, the indoor heat exchanger unit 5 comprises the indoor heat exchanger 50, an auxiliary pipe 51, a heat exchanger support member 52, etc. FIG. 4 is a right side view of the indoor unit 2 with the upper casing 6 removed; FIG. 5 is a top view of the indoor unit 2 with the upper casing 6 removed; and FIG. 6 is a perspective view of the right-hand portion of the indoor heat exchanger unit 5.

<Indoor Heat Exchanger>

Figure 7:
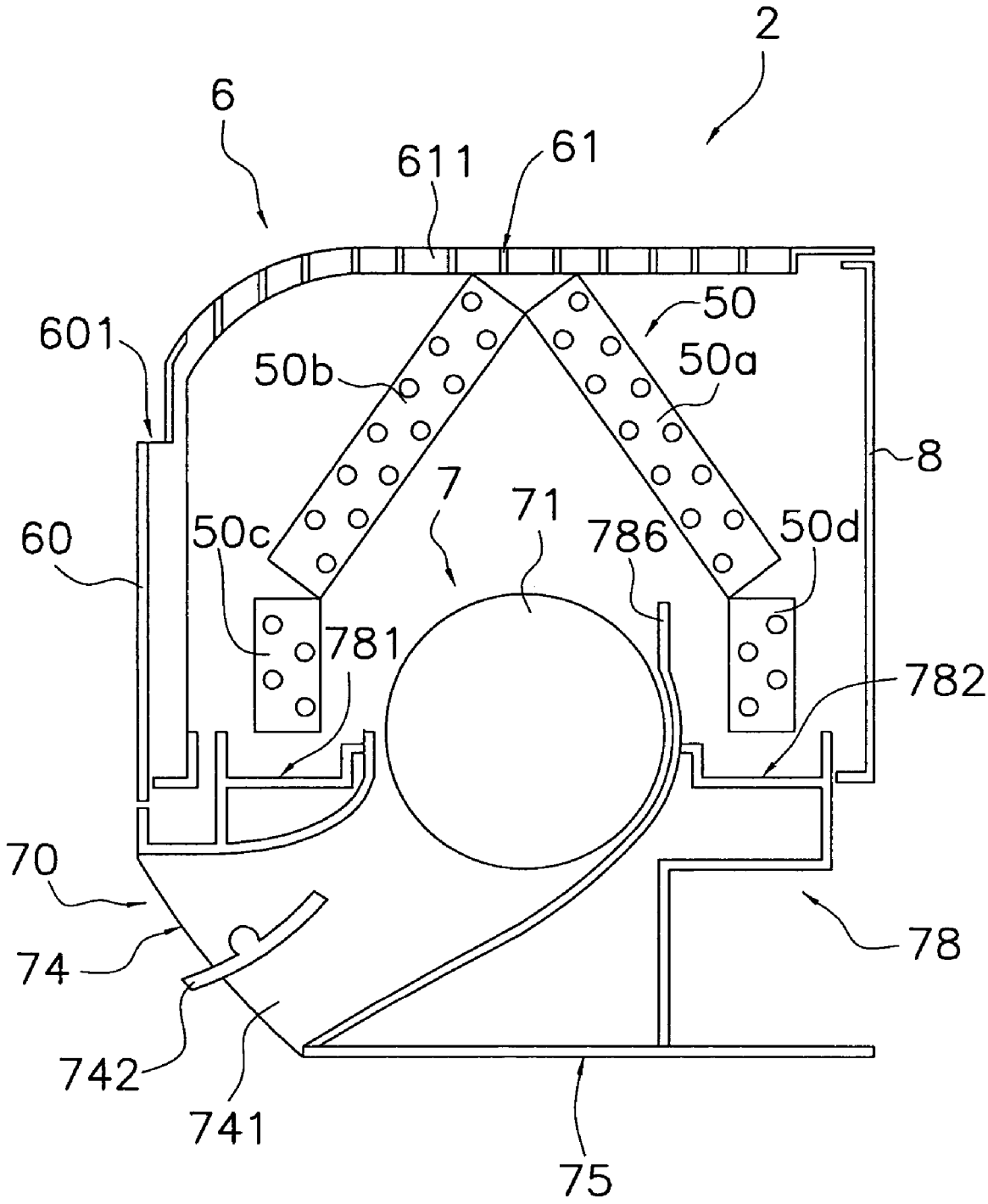
FIG. 7 is a right-side cross sectional view of the indoor unit.

As shown in FIG. 7, the indoor heat exchanger 50 is arranged in such a manner as to face the outer circumference of the cross flow fan 71 and surround the front, top, and rear of the cross flow fan 71. FIG. 7 is a side cross sectional view of the indoor unit 2. As it rotates, the cross flow fan 71 draws air into the indoor unit 2 through intake vents 601, 611. As the air moves toward the cross flow fan 71, it exchanges heat with the refrigerant inside the heat exchanger tube. The indoor heat exchanger 50 is divided into four sections: a first indoor heat exchanger 50*a*, a second indoor heat exchanger 50*b*, a third indoor heat exchanger 50*c*, and a fourth indoor heat exchanger 50*d*. The indoor heat exchangers 50*a*, 50*b*, 50*c*, 50*d* are joined together such that the indoor heat exchanger 50 has the cross sectional shape of generally inverted letter V, i.e., both ends bent downward.

The indoor heat exchangers 50*a*, 50*b*, 50*c*, 50*d* each have the shape of a horizontally elongated board. Each indoor heat exchanger 50*a*, 50*b*, 50*c*, 50*d* comprises a heat exchanger tube that has been folded back and forth a plurality of times at both lateral ends of the heat exchangers and a plurality of flat rectangular fins through which the heat exchanger tube has been passed. The portions where heat exchanger tube folds back at both lateral ends of each indoor heat exchanger 50*a*, 50*b*, 50*c*, 50*d* are formed by U-shaped heat exchanger tubes.

The first indoor heat exchanger 50*a* is slanted upward toward the front of the indoor unit 2 and is arranged such that it covers the portion of the cross flow fan 71 ranging from an upper central portion to an upper rear portion of the cross flow fan 71.

The second indoor heat exchanger 50*b* is slanted upward toward the rear of the indoor unit 2 and is arranged in front of the first indoor heat exchanger 50*a*. The upper end of the second indoor heat exchanger 50*b* is joined to the upper end of the first indoor heat exchanger 50*a* such that, in a side view, the first indoor heat exchanger 50*a* and the second indoor heat exchanger 50*b* form the shape of an inverted letter V. The second indoor heat exchanger 50*b* is arranged such that it covers the portion of the cross flow fan 71 ranging from an upper central portion to an upper front portion of the cross flow fan 71.

The third indoor heat exchanger 50*c* is arranged below the second indoor heat exchanger 50*b* in such a position as to cover a front portion of the cross flow fan 71. The upper end of the third indoor heat exchanger 50*c* is joined to the lower end of the second indoor heat exchanger 50*b* in such a manner that an obtuse angle exists between the third indoor heat exchanger 50*c* and the second indoor heat exchanger 50*b*. The third indoor heat exchanger 50*c* is arranged parallel to the height direction, i.e., the vertical direction, and is perpendicular to the lower unit 7, which covers a horizontal plane below the indoor heat exchanger 50. The lower end of the third indoor heat exchanger 50*c* is the lower end of the indoor heat exchanger 50, and the lower end of the third indoor heat exchanger 50*c*, i.e., the forward lower end of the indoor heat exchanger 50, is positioned at approximately the same height as the center axis of the cross flow fan 71.

The fourth indoor heat exchanger 50*d* is arranged below the first indoor heat exchanger 50*a* in such a position as to cover a rear portion of the cross flow fan 71. The upper end of the fourth indoor heat exchanger 50*d* is joined to the lower end of the first indoor heat exchanger 50*a* in such a manner that an obtuse angle exists between the fourth indoor heat exchanger 50*d* and the first indoor heat exchanger 50*a*. The fourth indoor heat exchanger 50*d* is arranged parallel to the height direction and is perpendicular to the lower unit 7 covering the horizontal surface of the bottom of the indoor heat exchanger 50. The lower end of the fourth indoor heat exchanger 50*d* is the rearward lower end of the indoor heat exchanger 50, and the lower end of the fourth indoor heat exchanger 50*d*, i.e., the rearward lower end of the indoor heat exchanger 50, is positioned at approximately the same height as the center axis of the cross flow fan 71.

The third indoor heat exchanger 50*c* and the fourth indoor heat exchanger 50*d* have the same dimension in the height direction, and the upper ends and lower ends of the third indoor heat exchanger 50*c* and fourth indoor heat exchanger 50*d* are positioned at the same heights, respectively. Thus, the forward lower end and rearward lower end of the indoor heat exchanger 50 are at the same height and are positioned at approximately the same height as the center axis of the cross flow fan 71. Also, the forward lower end and rearward lower end of the indoor heat exchanger 50 are located vertically below the forward and rearward lower ends of the inverted V-shaped portion and are positioned at approximately the same height as the center axis of the cross flow fan 71.

The first indoor heat exchanger 50*a*, the second indoor heat exchanger 50*b*, the third indoor heat exchanger 50*c*, and the fourth indoor heat exchanger 50*d* are fastened to each other by fastening plates provided on both lateral ends thereof (i.e., the leftward and rightward facing ends in a frontal view) so as to form a single integral unit that constitutes the indoor heat exchanger 50. The cross sectional shape of the indoor heat exchanger 50 is a combination of the inverted V-shaped portion formed by the first indoor heat exchanger 50*a* and the second indoor heat exchanger 50*b* and the straight-line portions that extend vertically downward from the lower ends of the first indoor heat exchanger 50*a* and the second indoor heat exchanger 50*b*. The indoor heat exchanger 50 is formed such that, in a vertical cross sectional view, it is horizontally symmetrical with respect to a vertical line of symmetry passing through the apex of the inverted V-shaped portion; the first indoor heat exchanger 50*a* and the second indoor heat exchanger 50*b* are horizontally symmetrical to each other and the third indoor heat exchanger 50*c* and the fourth indoor heat exchanger 50*d* are horizontally symmetrical to each other with respect to said line of symmetry. While the indoor heat exchanger 50 has a cross sectional shape that includes a horizontally symmetrical inverted V-shaped portion in a side view as described above, it has a horizontally elongated shape in a frontal view. The long of lengthwise direction of the indoor heat exchanger 50 is approximately the same as the lengthwise dimension of the cross flow fan 71 and the lateral ends of the indoor heat exchanger 50 are substantially aligned with the lateral ends of the cross flow fan 71.

<Auxiliary Pipe>

The auxiliary pipe 51 connects the indoor heat exchanger 50 to the refrigerant pipe 4 located outside the indoor unit 2 and serves as a passage for the refrigerant that flows between the indoor heat exchanger 50 and the outdoor heat exchanger 30. As shown in FIG. 6, the auxiliary pipe 51 is connected to the heat exchanger tube of the indoor heat exchanger 50 and extends outward from the side face of the indoor heat exchanger 50. The auxiliary pipe 51 protrudes from the right-hand side face of the indoor heat exchanger 50 and is routed through the space adjacent to the side face of the indoor heat exchanger 50. More specifically, as shown in FIG. 5, the auxiliary pipe 51 extends outward from the right-hand side face of the indoor heat exchanger 50, passes over the indoor fan motor 72 and a motor cover section 55 (i.e., motor cover, discussed later) that covers the indoor fan motor 72, and reaches beyond the indoor fan motor 72 and motor cover section 55 into the space above a communication passage 783 (discussed later). From there, as shown in FIG. 4, the auxiliary pipe 51 bends toward the back of the indoor unit 2 and slightly downward, passes along a path located laterally to the outside of the motor cover section 55 that covers the indoor fan motor 72, and bends upward again at the back of the indoor unit 2. Then, the plurality of auxiliary pipes 51 are congregated together and covered with a protective tube 53. As shown in FIGS. 4 and 6, the congregated auxiliary pipes 51 extend downward through the space on the right side of the indoor heat exchanger 50 along the back of the indoor unit 2, bend again toward left side of the indoor unit 2 in the space below the rear portion of the bottom of the indoor unit 2, and connect to the refrigerant pipe 4.

The heat exchanger support member 52 is provided in the vicinity of the right-hand side face of the indoor heat exchanger 50 and, as shown in FIG. 4, serves both to support the indoor heat exchanger 50 from underneath and to cover the indoor fan motor 72. The heat exchanger support member 52 protects the indoor fan motor 72 from drain water. The constituent features of the heat exchanger support member 52 will be discussed later.

<Upper Casing>

As shown in FIG. 3 and FIG. 7, the upper casing 6 forms the upper part of the indoor unit 2 and comprises an upper front section 60, a top section 61, and upper side sections 62, 63.

The upper front section 60 covers the front upper portion of the indoor unit 2, i.e., the area in front of the indoor heat exchanger 50. The upper front section 60 is generally flat and is provided with a step-like section on a portion thereof. In the upper face of the step-like section is provided a front intake vent 601 comprising a slit-like opening that is long in the lengthwise direction of the indoor unit 2. The front intake vent 601 is arranged so as to face upward toward the space above the indoor unit 2.

The top section 61 covers the top portion of the indoor unit 2, i.e., the area above the indoor heat exchanger 50. In the top section 61 are provided a plurality of top intake vents 611 comprising slit-like openings. The top intake vents 611 are arranged facing rearward from the front of the top section 61 and have a larger intake cross sectional area than the front intake vent 601. Consequently, an ample amount of air is drawn into the indoor unit 2 from the rearward side of the top part.

The upper side sections 62, 63 cover the upper portions of the sides of the indoor unit 2, i.e., the areas laterally adjacent to the indoor heat exchanger 50. The upper side sections 62, 63 comprise a right upper side section 62 and a left upper side section 63, the right upper side section 62 being arranged on the right-hand side of the indoor heat exchanger 50 in a frontal view and the left upper side section 63 being arranged on the left-hand side of the indoor heat exchanger 50 in a frontal view.

The bottom edge of the upper casing 6 is formed to be horizontal so that when the upper casing 6 is placed on the lower unit 7, the boundary between the upper casing 6 and the lower unit 7 appears as a horizontal line in an external frontal view or side view of the indoor unit 2.

<Lower Unit>

Figure 8:
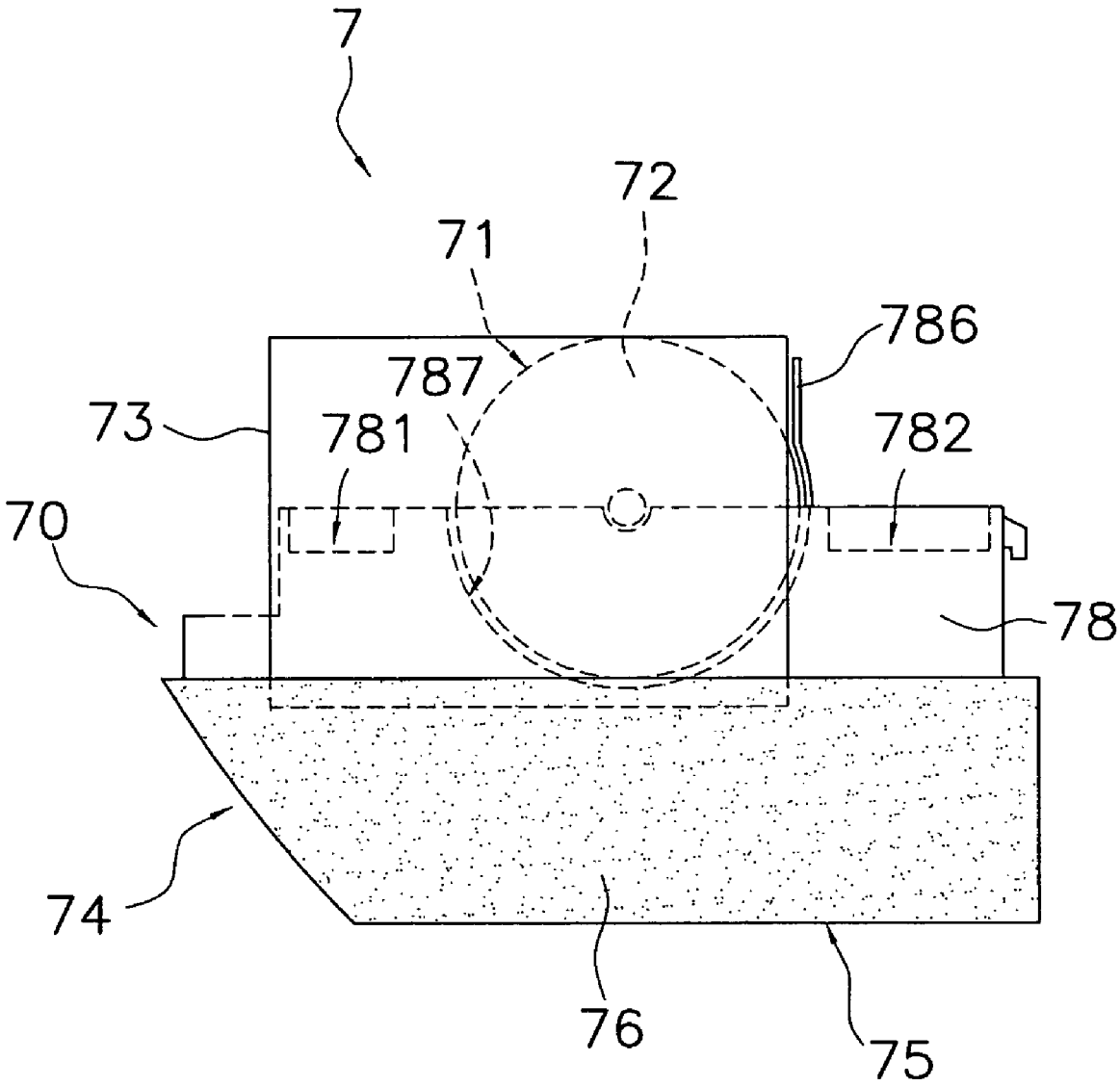
FIG. 8 is a right side view of a lower unit.
Figure 9:
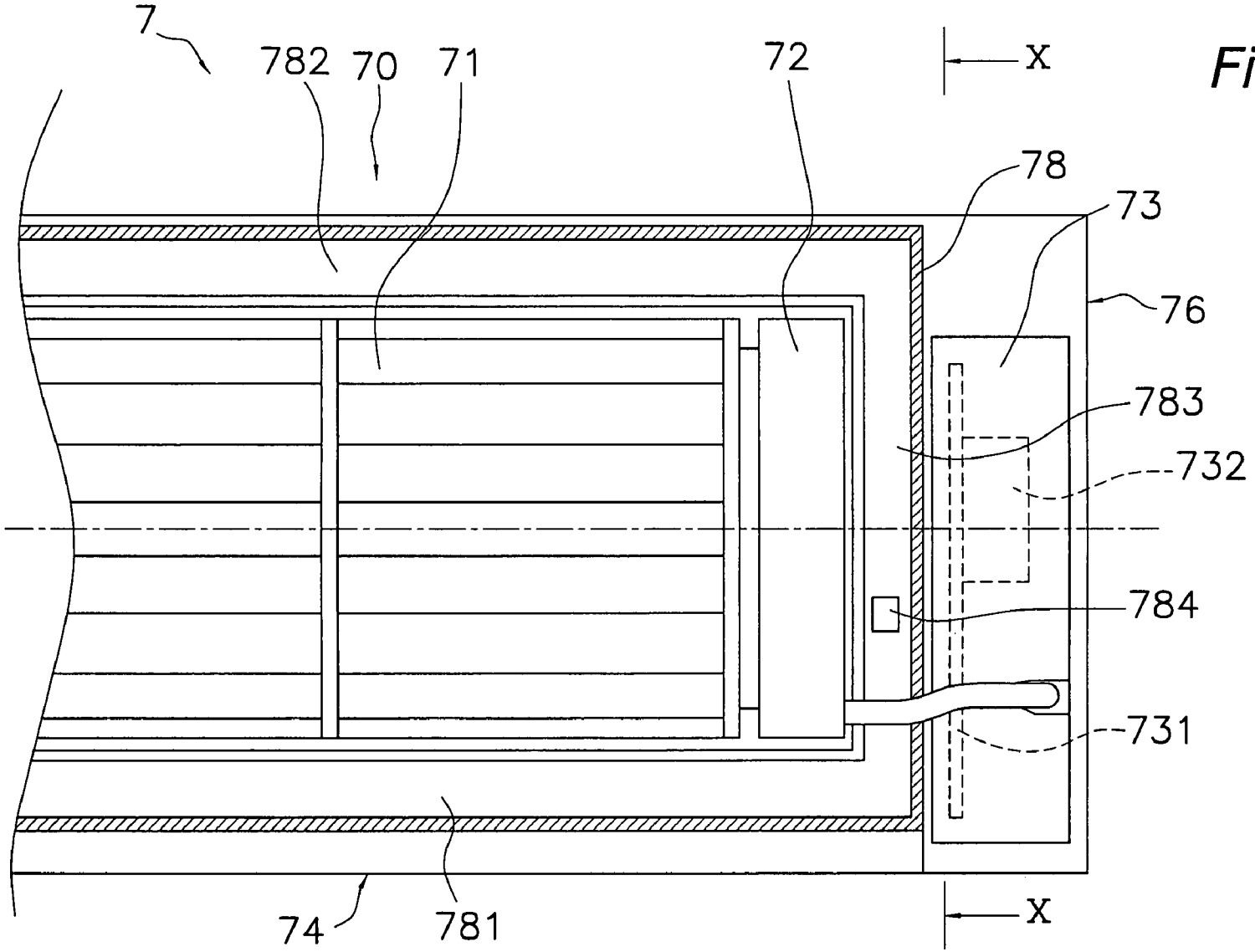
FIG. 9 is a top view of the right-hand portion of the lower unit.

The lower unit 7 constitutes the lower part of the indoor unit 2 and, as shown in FIGS. 8 and 9, comprises a module that includes a lower casing 70, the cross flow fan 71, the indoor fan motor 72, and an electrical component box 73.

<Lower Casing>

The lower casing 70 comprises a lower front section 74, a bottom section 75, lower side sections 76, 77, and a support part 78. The color of the lower casing 70 is different from the color of the upper casing 6.

The lower front section 74 is the portion that is visible as the front, lower part of the indoor unit 2 in a frontal view and is arranged such that its upper edge leans toward the front of the indoor unit 2. As shown in FIG. 3(*a*), the upper edge of the lower front section 74 is horizontal and forms a horizontal boundary line together with the lower edge of the upper casing 6. The lower front section 74 is provided with an outlet vent 741 comprising an opening that runs along the lengthwise direction of the indoor unit 2. As shown in FIG. 7, this outlet vent 741 communicates with the space inside the support part 78 that houses the cross flow fan 71. The air flow generated by the cross flow fan 71 is discharged into the room through the outlet vent 741. The outlet vent 741 is provided with a horizontal flap 742 serving to guide the air that is discharge into the room. The horizontal flap 742 is provided in such a manner that it can turn freely about an axis running parallel to the lengthwise direction of the indoor unit 2 and can open and close the outlet vent 741 by being rotationally driven by a flap motor (not shown).

The bottom section 75 is flat and covers the bottom of the indoor unit 2. The bottom section 75 is arranged in a horizontal orientation and the support part 78 is arranged there-above.

The lower side sections 76, 77 are the portions that are visible as the lower portions of the side face of the indoor unit 2 in a side view and serve to cover the lower portions of the side face of the indoor unit 2. The lower side sections 76, 77 comprise a right lower side section 76 and a left lower side section 77, the right lower side section 76 being arranged on the right-hand side of the indoor heat exchanger 50 in a frontal view and the left lower side section 77 being arranged on the left-hand side of the indoor heat exchanger 50 in a frontal view. The upper edges of the lower side sections 76, 77 are horizontal, similarly to the upper edge of the lower front section 74. When the upper casing 6 is placed on the lower unit 7, the lower edge of the upper casing 6 aligns with the upper edges of the lower front section 74 and the lower side sections 76, 77 of the lower unit 7 so as to form a horizontal boundary line.

The support part 78 is surrounded by the lower front section 74, the bottom section 75, and the lower side sections 76, 77 and the upper surface of the support part 78 is positioned above the upper edges of the lower front section 74, the bottom section 75, and the lower side sections 76, 77. The cross flow fan 71, the indoor fan motor 72, the electrical component box 73, and the indoor heat exchanger unit 5 are mounted to the support part 78 from above and the support part 78 supports the cross flow fan 71, the indoor fan motor 72, the electrical component box 73, and the indoor heat exchanger unit 5 from below.

The support part 78 supports the indoor heat exchanger 50 through the heat exchanger support member 52 of the indoor heat exchanger unit 5. The upper surface of the support part 78 is at approximately the same height as the center axis of the cross flow fan. Drain pans 781, 782 and a fan housing section 787 are provided in the upper surface of the support part 78.

Figure 10:
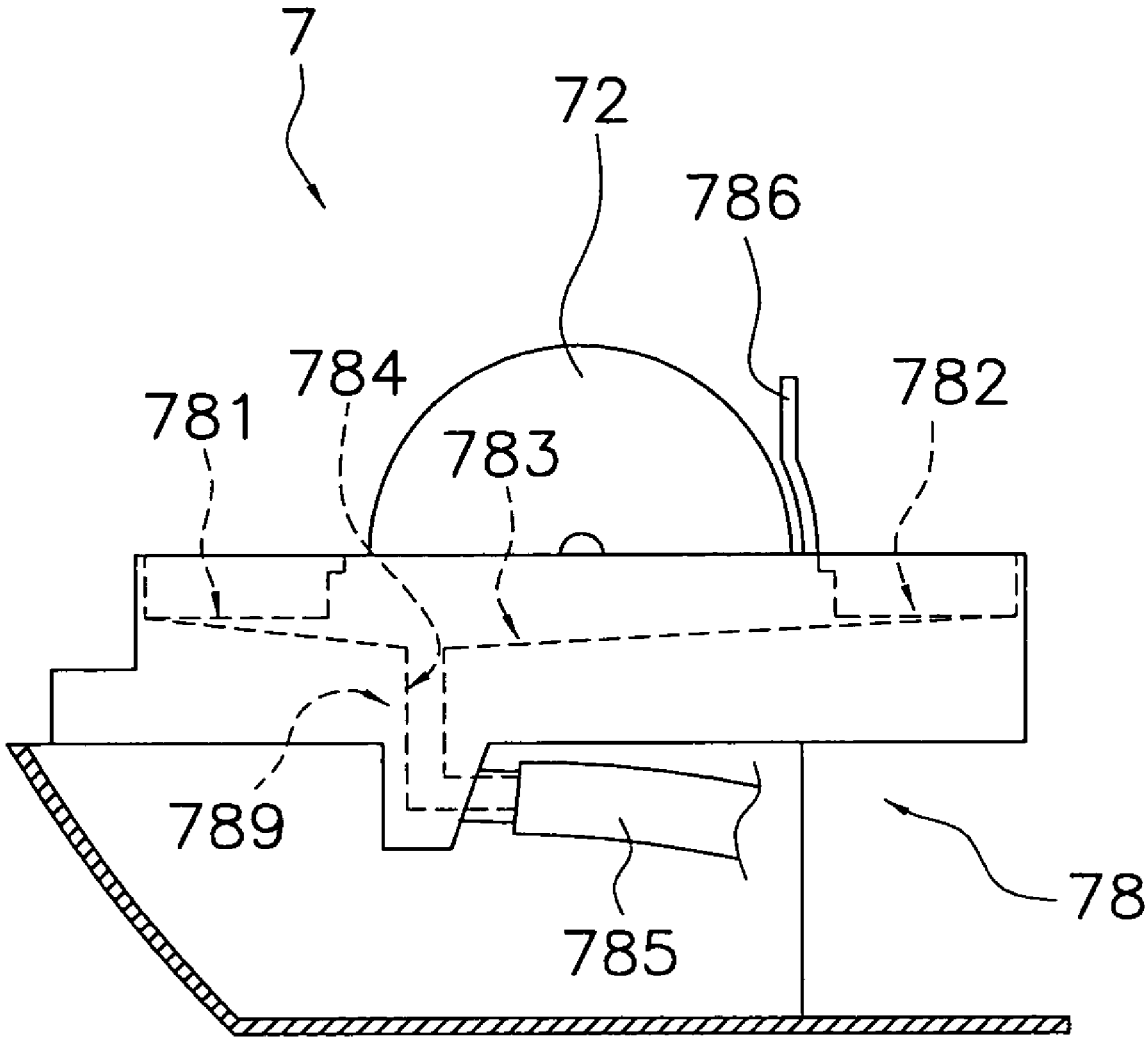
FIG. 10 is a right side cross sectional view of the lower unit.

The drain pans 781, 782 are concave members that are depressed downward from the upper surface of the support part 78 and serve to catch water droplets that form on the surface of the indoor heat exchanger 50 during the course of exchanging heat. The drain pans 781, 782 comprise a front drain pan 781 (first drain pan) and a rear drain pan 782 (second drain pan). The front drain pan 781 is arranged below the third heat exchanger 50*c*, i.e., below the forward, lower end of the heat exchanger 50, as shown in FIG. 5. The rear drain pan 782 is arranged below the fourth indoor heat exchanger 50*d*, i.e., below the rearward, lower end of the indoor heat exchanger 50. The front drain pan 781 and the rear drain pan 782 are arranged to the front and rear of each other with the cross flow fan 71 there-between. The front drain pan 781 and the rear drain pan 782 are arranged at approximately the same height. The bottom surfaces of the front drain pan 781 and the rear drain pan 782 are positioned lower than the height of the center axis of the cross flow fan 71 but close to the lower ends of the indoor heat exchanger 50. The bottom surfaces of the front drain pan 781 and the rear drain pan 782, i.e., the surfaces that catch drain water, are slightly slanted toward the right side of the indoor unit 2. As shown in FIGS. 9 and 10, the right-hand portion of the support part 78 is provided with a communication passage 783 that connects the front drain pan 781 and the rear drain pan 782 together. As shown in FIG. 9, the communication passage 783 is positioned between the indoor fan motor 72 and the electrical component box 73 in a top plan view. As shown in FIG. 10, the communication passage 783 is positioned at or below the height of the rotational axis of the cross flow fan 71 in a side view. A water draining section 789 is provided in a non-interrupted manner on the communication passage 783. The water draining section 789 is provided with a water draining hole 784 that passes downward from the communication passage 783. As shown in FIG. 9, the water draining hole 784 communicates with the inside of a drain hose 785 serving to discharge drain water from the drain pans 781, 782 to the outside. The drain water that drips from the indoor heat exchanger 50 and the auxiliary pipes 51 is caught in the front drain pan 781 and the rear drain pan 782, collected in the communication passage 783, and discharged to the outside of the indoor unit through the water draining hole 784 and the drain hose 785. The front drain pan 781, the rear drain pan 782, the communication passage 783, and the water draining hole 784 are formed as a single integral unit with no joints or seams. More specifically, the right-hand end of the front drain pan 781 is connected integrally to the frontward end of the communication passage 783 and the right-hand end of the rear drain pan 782 is connected integrally to the rearward end of the communication passage 783. The communication passage 783 is also formed integrally with the water draining section 789. Consequently, the bottom surface of the communication passage 783 where drain water is caught is connected in an uninterrupted manner without joints or seams to the water draining hole 784 of the water draining section 789.

The fan housing section 787 is a portion where the cross flow fan 71 and the indoor fan motor 72 are housed and is arranged at the approximate center of the upper surface of the support part 78. The fan housing section 787 is a concave member that is depressed downward in a semi-cylindrical shape from the upper surface of the support part 78, and houses the lower half of the cross flow fan 71 and the indoor fan motor 72. Inside the support part 78 is provided with an air passage leading from the housed cross flow fan 71 to the outlet vent 741.

The support part 78 is also provided with a tongue part 786 that protrudes upward from the upper surface of the support part 78 between the rear drain pan 782 and the cross flow fan 71. The tongue part 786 covers the rear of the cross flow fan 71 and the upper end of the tongue part 786 is positioned slightly lower than the height of the top portion of the cross flow fan 71.

Although the front drain pan 781, the rear drain pan 782, the fan housing section 787, and the upwardly projecting tongue part 786 are provided on the upper surface of the support part 78, the other portions of the upper surface of the support part 78 are generally flat and horizontal and positioned at approximately the same height as the center line of the cross flow fan 71.

As described above, the highest portion of the support part 78 is the tongue part 786 but the tongue part 786 is positioned at or below the height of the top portion of the cross flow fan 71. Meanwhile, the upper surface of the support part 78 is positioned above the upper edges of the lower front section 74 and the lower side sections 76, 77. Consequently, no portion of the lower casing 70, including the support part 78, is positioned at or below the height of the top portion of the cross flow fan 71.

The rear side of the upper surface of the support part 78, too, is at or below the height of the cross flow fan 71 and the space between the rear side of the top section 61 of the upper casing 6 and rear side of the upper surface of the support part 78 is filled with a mounting plate 8 (see FIG. 7) that is used for mounting the indoor unit 2 to an indoor wall. The mounting plate 8 has approximately the same length as the indoor heat exchanger 50 in the lengthwise direction of the indoor unit 2 and serves to cover the rear side of the indoor heat exchanger 50. By covering the rear side of the indoor unit 2, the mounting plate 8, together with the upper casing 6, forms an air flow path for the air entering the indoor heat exchanger 50 to follow. More specifically, the mounting plate 8 forms a rear air flow path.

<Cross Flow Fan>

The cross flow fan 71 has an elongated cylindrical shape and is arranged such that its center axis, i.e., rotational axis, is oriented in a horizontal direction. The cross flow fan 71 is provided with vanes around its outer circumference and the vanes are configured to generate a flow of air when the cross flow fan 71 rotates about its rotational axis. The flow of air is drawn in through the front intake vent 601 and the top intake vents 611, passes through the indoor heat exchanger 50, and is blown into the room from the outlet vent 741. The cross flow fan 71 is positioned generally in the middle of the indoor unit 2 in a side view. The cross flow fan 71 is supported by the support part 78 and, when it is in the supported state, the upper half of the cross flow fan 71 protrudes upward from the upper surface of the support part 78.

<Indoor Fan Motor>

The indoor fan motor 72 is configured and arranged to drive the cross flow fan 71 such that the cross flow fan 71 rotates about its rotational axis. As shown in FIGS. 8 and 9, the indoor fan motor 72 has the shape of a short cylinder with a diameter approximately the same as the diameter of the cross flow fan 71. The indoor fan motor 72 is arranged on the right side of the cross flow fan 71 and is coaxial with respect to the cross flow fan 71. In a top plan view, the indoor fan motor 72 is arranged adjacent to the cross flow fan 71 along the rotational axis. The indoor fan motor 72 is arranged closely adjacent to the right side of the cross flow fan 71 and the communication passage 783 is arranged closely adjacent to the right side of the indoor fan motor 72. In a top plan view, the indoor fan motor 72 and the cross flow can 71 are surrounded by the front drain pan 781, the communication passage 783, and the rear drain pan 782. When the indoor fan motor 72 is mounted to the support part 78, the heights of the top portions of the indoor fan motor 72 and the cross flow fan 71 are approximately the same (see FIG. 8).

<Electrical Component Box>

As shown in FIG. 5 and FIG. 9, the electrical component box 73 houses a control board 731 for controlling the operation of the indoor unit 2. The electrical component box 73 has a rectangular box-like shape, is arranged between the support part 78 and the right lower side section 76 of the lower casing 70, and is positioned to the right of the indoor heat exchanger unit 5. The electrical component box 73 is arranged to the outside of the support part 78 and is arranged adjacent to the communication passage 783 along the rotational axis of the cross flow fan 71 in a top plan view. Thus, in a top plan view, the cross flow fan 71, the indoor fan motor 72, the communication passage 783, and the electrical component box 73 are arranged along the rotational axis in order as listed. The electrical component box 73 is supported on the right-hand side face of the support part 78 to the right of the indoor fan motor 72 and can be mounted to the support part 78 before the indoor heat exchanger unit 5 is mounted to the lower unit 7. The electrical component box 73 is arranged closer to the front of the indoor unit 2 than to the rear of the same and the space to the rear of the electrical component box 73 serves as a space for passing the auxiliary pipes 51 covered with the protective tube 53 (discussed before). The electrical component box 73 is arranged such that the larger-capacity control components mounted to the control board 731, i.e., such strong-electric-current components 732 as capacitors and power transistors, are arranged along the axial direction of the indoor fan motor 72 and such that, in a side view, the indoor fan motor 72 and the electrical component box 73 overlap. When the electrical component box 73 is supported on the lower casing 70, the upper surface the electrical component box 73 is positioned at approximately the same height as the top portion of the indoor fan motor 72, i.e., the top portion of the cross flow fan 71.

Thus, when the cross flow fan 71 are supported on the lower casing 70, no portion of the indoor fan motor 72, the electrical component box 73, or the lower casing 70 is positioned higher than the top portion of the cross flow fan 71. In this way, the lower unit 7 as a whole has a comparatively small height dimension.

<Heat Exchanger Support Member>

The constituent features of the heat exchanger support member 52 will now be explained based on FIGS. 5 and 6. The heat exchanger support member 52 is provided near the right-hand side face of the heat exchanger 50 and has a heat exchanger support section 54, a motor cover section 55, and a drain water guide section 56 (water guiding passage).

The heat exchanger support section 54 is a sheet-like portion shaped to follow the inverted V-shape of the indoor heat exchanger 50 and serves to support the indoor heat exchanger 50 from underneath.

The motor cover section 55 covers the upper half of the indoor fan motor 72 and comprises chiefly an upper cover section 551, a side cover section 552, a front cover section 553, and a rear cover section 554.

The upper cover section 551 is curved in a circular arc shape and protrudes sideways toward the indoor heat exchanger 50 from the heat exchanger support section 54. The upper cover section 551 faces the upper half of the outer circumference of the indoor fan motor 72 and covers above the indoor fan motor 72.

The side cover section 552 is a generally semicircular sheet-like portion arranged perpendicular to the upper cover section 551. The side cover section 552 is arranged facing the upper half of the circular face forming the right-hand end face of the indoor fan motor 72 and covers the right-hand side of the indoor fan motor 72.

The front cover section 553 and rear cover section 554 cover the front and rear of the indoor fan motor 72.

As described previously, the auxiliary pipes 51 extend outward from the side face of the indoor heat exchanger 50 and, thus, the motor cover section 55 is positioned below the auxiliary pipes 51. The motor cover section 55 is shaped such that drain water that drips from the auxiliary pipes 51 flows toward the drain water guide section 56 and serves to protect the indoor fan motor 72 from drain water.

The drain water guide section 56 arranged around the front, right side, and rear of the motor cover section 55 and serves to guide drain water that has dripped down onto and flowed from the motor cover 55 to the drain pans 781, 782 and the communication passage 783. The drain water guide section 56 has a bottom section 561 and a side wall section 562 that, in a top plan view, have the shape of a rectangular letter U that runs along the front, right-hand side, and rear of the motor cover section 55.

The bottom section 561 is connected perpendicularly to the bottom edges of the side cover section 552, the front cover section 553, and the rear cover section 554. The left-hand edge of the portion of the bottom section 561 positioned in front of the motor cover section 55 is closely adjacent to the lower end of the side face of the third indoor heat exchanger 50*c* and is positioned above the front drain pan 781. The left-hand edge of the portion of the bottom section 561 positioned to the rear of the motor cover section 55 is closely adjacent to the lower end of the side face of the fourth indoor heat exchanger 50*d* and is positioned above the rear drain pan 782.

The side wall section 562 stands vertically upward from the bottom section 561 and serves to guide the drain water.

A gap is provided between the lower end of the side face of the third indoor heat exchanger 50*c* and the left-hand edge of the forward portion of the bottom section 561. Similarly, a gap is provided between the lower end of the side face of the fourth indoor heat exchanger 50*d* and the left-hand edge of the rearward portion of the bottom section 561. Consequently, the drain water caught by the drain water guide section 56 flows into the front drain pan 781 and the rear drain pan 782 through these gaps and is discharged to the outside of the indoor unit 2 (see unshaded arrow A1 of FIG. 6). A cutaway section 563 is provided in a portion of the side wall section 562 positioned to the right of the motor cover section 55, and drain water that drips down onto the motor cover section 55 is discharged also through this cutaway section 563. The portion of the side wall section 562 positioned to the right of the motor cover section 55 is located above the communication passage 783 such that it overlaps a part of the communication passage 783 in a top plan view. Drain water discharged from the cutaway section 563 is caught by the communication passage 783 and discharged to the outside of the indoor unit 2.

In this way, the communication passage 783 is arranged along the rotational axis of the cross flow fan 71 in a top plan view so that it is positioned beyond the motor cover section 55 and can catch drain water that has dripped from the auxiliary pipes 51. More specifically, drain water that drips down from the auxiliary pipes 51 is caught by the upper cover section 551, the drain water guide section 56, or the communication passage 783.

Drain water that drips onto the upper cover section 551 flows forward, rearward, or sideways along the curved surface and into the drain water guide section 56. The drain water then flows from the left-hand edge of the drain water guide section 56 into the front drain pan 781 or the rear drain pan 782 and is discharged to the outside of the indoor unit 2. Drain water that flows sideways across the upper cover section 551 empties from the cutaway section 563 of the drain water guide section 56 to the communication passage 783 and is discharged to the outside of the indoor unit 2.

Similarly, rain water that falls directly into the drain guide section 56 flows either from the left-hand edge of the drain water guide section 56 into the front drain pan 781 or the rear drain pan 782 or from the cutaway section 563 to the communication passage 783 and is discharged to the outside of the indoor unit 2.

Additionally, since the auxiliary pipes 51 extend beyond the motor cover section 55 above the communication passage 783, drain water sometimes drips from the auxiliary pipes 51 directly into the communication passage 783. In such a case, the drain water is caught by the communication passage 783 and discharged to the outside of the indoor unit 2.

<Characteristic Features>

<1>

In this indoor unit 2 for the air conditioner 1, the cross flow fan 71, the indoor fan motor 72, and the communication passage 783 are arranged in order as listed along the rotational axis of the cross flow fan 71 in a top plan view. As a result, drain water that drips onto the motor cover section 55 covering the indoor fan motor 72 and flows to the outside of the motor cover 55 can be caught in the communication passage 783.

Meanwhile, drain water that drips onto the motor cover section 55 and flows forward or rearward along the motor cover section 55 can be caught in the front drain pan 781 and the rear drain pan 782 and disposed of.

In this way, with this indoor unit 2 for an air conditioner 1, it is not necessary to provide ribs or the like on the motor cover in order to prevent drain water from flowing toward the outside. Instead, drain water that flows outward along the motor cover section 55 can be disposed of by the communication passage 783. As a result, this indoor unit 2 for an air conditioner 1 enables the drain water to be disposed of using a simple configuration.

<2>

In this indoor unit 2 for an air conditioner 1, the communication passage 783 is provided between the electrical component box 73 and the indoor fan motor 72. Thus, drain water that drips onto the motor cover 55 is caught by the communication passage 783 and disposed of before it can reach the electrical component box 73. As a result, with this indoor unit 2 for an air conditioner 1, drain water is prevented from flowing to the electrical component box 73.

<3>

In this indoor unit 2 for an air conditioner 1, drain water that drips onto the motor cover section 55 is guided to the front drain pan 781, the rear drain pan 782, or the communication passage 783 by the drain water guide section 56. As a result, with this indoor unit 2 for an air conditioner 1, it is easy for drain water that drips onto the motor cover 55 to flow to the front drain pan 781, the rear drain pan 782, or the communication passage 783 and the drain water can be disposed of more efficiently.

<4>

In this indoor unit 2 for an air conditioner 1, the auxiliary pipes 51 extend to the space above the communication passage 783. In other words, the auxiliary pipes 51 extend not only over the motor cover section 55 but also beyond the motor cover section 55 to the space above the communication passage 783. Thus, with this indoor unit 2 for an air conditioner 1, the installation space for the auxiliary pipes 51 is enlarged such that the degree of freedom with respect to the routing of the auxiliary pipes 51 is increased.

Additionally, since any drain water that drips from the auxiliary pipes 51 can be caught by the communication passage 783, drain water that drips from the auxiliary pipes 51, too, can be disposed of appropriately.

<5>

With this indoor unit 2 for an air conditioner 1, the communication passage 783 is positioned at or below the height of the rotational axis of the cross flow fan 71, which is a comparatively low position within the indoor unit 2 for an air conditioner 1. Thus, the positions of the front drain pan 781 and the rear drain pan 782 are also lower. Consequently, the position of the indoor heat exchanger 50 can also be lowered. As a result, the height dimension of this indoor unit 2 for an air conditioner 1 is reduced.

<6>

In this indoor unit 2 for an air conditioner 1, the front drain pan 781, the rear drain pan 782, the communication passage 783, and the water draining hole 784 are formed as a single integral unit with no joints or seams. If these parts are formed as separate entities and joined together, there will be small gaps at the joints between the parts and there will be the possibility of water leaking from the gaps. Conversely, since the front drain pan 781, the rear drain pan 782, the communication passage 783, and the water draining hole 784 of this indoor unit 2 for an air conditioner 1 are formed as a single integral unit, there are no such gaps and there is less risk of water leakage occurring.

<7>

In this indoor unit 2 for an air conditioner 1, the auxiliary pipes 51 extend outward from the side face of the indoor heat exchanger 50 to a position that is beyond the indoor fan motor 72 and the motor cover 55. Consequently, the auxiliary pipes 51 can be routed such that they pass to the outside of the motor cover section 55. Thus, as shown in FIG. 4, the auxiliary pipes 51 and the motor cover section 55 can be arranged such that they overlap in a side view.

If the auxiliary pipes 51 do not extend to a position beyond the indoor fan motor 72 and the motor cover section 55, the ability to extend the auxiliary pipes 51 downward will be restricted because the indoor fan motor 72 and the motor cover section 55 will be positioned below the auxiliary pipes 51.

Since the auxiliary pipes 51 extend outward to a position that is beyond the indoor fan motor 72 and the motor cover 55 in this indoor unit 2 for an air conditioner 1, the auxiliary pipes 51 can be extended downward to a height where they overlap the motor cover section 55 in a side view. As a result, with this indoor unit 2 for an air conditioner 1, the space through which the auxiliary pipes 51 can be routed is enlarged and the degree of freedom with respect to routing the auxiliary pipes 51 can be increased.

<8>

In this indoor unit 2 for an air conditioner 1, the communication passage 783 is arranged such that it extends laterally outward to a position beyond the motor cover section 55 of the heat exchanger support member 52. As a result, the communication passage 783 can catch drain water that drips from the auxiliary pipes 51, which also extend to a position beyond the motor cover section 55. As a result, with this indoor unit 2 for an air conditioner 1, drain water that drips from the auxiliary pipes 51 can be disposed of appropriately.

<Other Embodiments>

The present invention can be embodied so long as, at least in a top plan view, the cross flow fan 71, the indoor fan motor 72, and the communication passage 783 are arranged in order as listed along the rotational axis of the cross flow fan 71. It is not necessary for the cross flow fan 71, the indoor fan motor 72, and the communication passage 783 to all be arranged at the same height.

Also, although in the previously described embodiment the electrical component box, too, is arranged along the rotational axis in a top plan view, it is also acceptable for the electrical component box to be arranged in a position where it does not intersect the rotational axis.

APPLICABILITY TO INDUSTRY

By utilizing an air conditioner indoor unit in accordance with this embodiment, the communication passage can catch any drain water that flows outward after dripping onto the motor cover that covers the motor because the blower fan, the motor, and the communication passage are arranged in order as listed along the rotational axis of the blower fan in a top plan view. Thus, the drain water can be disposed of with a simple configuration.

What is claimed is:

1. An indoor unit for an air conditioner, comprising:

a blower fan having a cylindrical shape that is arranged such that its rotational axis is substantially horizontal;

a heat exchanger covering an upper side of the blower fan and facing an outer circumference of the blower fan;

an auxiliary pipe extending outwardly from a side face of the heat exchanger;

a motor arranged adjacent to the blower fan along the rotational axis and configured to rotationally drive the blower fan;

a motor cover arranged below the auxiliary pipe to cover the motor;

a first drain pan and a second drain pan arranged on opposite sides of the blower fan to sandwich the blower fan and configured to catch drain water that drips from the heat exchanger; and a communication passage arranged adjacent to the motor cover along the rotational axis in a top plan view and configured to link the first drain pan and the second drain pan together, the blower fan, the motor, and the communication passage being arranged such that in a top plan view they are positioned along the rotational axis in a following order: the blower fan, the motor, and the communication passage.

2. The indoor unit recited in claim 1, further comprising an electrical component box housing electrical components; and the blower fan, the motor, the communication passage, and the electrical component box being arranged such that in a top plan view they are positioned along the rotational axis in a following order: the blower fan, the motor, the communication passage, and the electrical component box.

3. The indoor unit as recited in claim 1, further comprising a water guiding passage configured and arranged to guide drain water that drips onto the motor cover to the communication passage.

4. The indoor unit as recited in claim 1, wherein the auxiliary pipe extends to a space above the communication passage.

5. The indoor unit as recited in claim 1, wherein the communication passage is positioned at or below a height of the rotational axis of the blower fan.

6. The indoor unit as recited in claim 1, wherein the first drain pan, the communication passage, and the second drain pan are formed as a single integral unit.

7. The indoor unit as recited in claim 6, further comprising a water draining section having a water draining hole that serves to discharge drain water to an outside area from the first drain pan, the communication passage, and the second drain pan; and the first drain pan, the communication passage, the second drain pan, and the water draining section are formed as a single integral unit.

8. The indoor unit as recited in claim 1, wherein the auxiliary pipe extends in a direction parallel to the rotational axis to a position beyond the motor.

9. The indoor unit as recited in claim 8, wherein the auxiliary pipe extends in a direction parallel to the rotational axis to a position beyond the motor cover.

10. The indoor unit as recited in claim 9, wherein the communication passage is arranged in a position beyond the motor cover in a direction parallel to the rotational axis.

11. The indoor unit as recited in claim 2, further comprising a water guiding passage configured and arranged to guide drain water that drips onto the motor cover to the communication passage.

12. The indoor unit as recited in claim 2, wherein the auxiliary pipe extends to a space above the communication passage.

13. The indoor unit as recited in claim 2, wherein the communication passage is positioned at or below a height of the rotational axis of the blower fan.

14. The indoor unit as recited in claim 2, wherein the first drain pan, the communication passage, and the second drain pan are formed as a single integral unit.

15. The indoor unit as recited in claim 14, further comprising a water draining section having a water draining hole that serves to discharge drain water to an outside area from the first drain pan, the communication passage, and the second drain pan; and the first drain pan, the communication passage, the second drain pan, and the water draining section are formed as a single integral unit.

16. The indoor unit as recited in claim 3, wherein the auxiliary pipe extends to a space above the communication passage.

17. The indoor unit as recited in claim 3, wherein the communication passage is positioned at or below a height of the rotational axis of the blower fan.

18. The indoor unit as recited in claim 3, wherein the first drain pan, the communication passage, and the second drain pan are formed as a single integral unit.

19. The indoor unit as recited in claim 18, further comprising a water draining section having a water draining hole that serves to discharge drain water to an outside area from the first drain pan, the communication passage, and the second drain pan; and the first drain pan, the communication passage, the second drain pan, and the water draining section are formed as a single integral unit.

20. The indoor unit as recited in claim 4, wherein the communication passage is positioned at or below a height of the rotational axis of the blower fan.

21. The indoor unit as recited in claim 4, wherein the first drain pan, the communication passage, and the second drain pan are formed as a single integral unit.

22. The indoor unit as recited in claim 21, further comprising a water draining section having a water draining hole that serves to discharge drain water to an outside area from the first drain pan, the communication passage, and the second drain pan; and the first drain pan, the communication passage, the second drain pan, and the water draining section are formed as a single integral unit.

23. The indoor unit as recited in claim 5, wherein the first drain pan, the communication passage, and the second drain pan are formed as a single integral unit.

24. The indoor unit as recited in claim 23, further comprising a water draining section having a water draining hole that serves to discharge drain water to an outside area from the first drain pan, the communication passage, and the second drain pan; and the first drain pan, the communication passage, the second drain pan, and the water draining section are formed as a single integral unit.

* * * * *